US010105717B2

(12) United States Patent
Mackel et al.

(10) Patent No.: US 10,105,717 B2
(45) Date of Patent: Oct. 23, 2018

(54) METHOD FOR OPERATING A SEPARATOR WITH A DRIVE CHAMBER UNDER NEGATIVE PRESSURE

(71) Applicant: GEA Mechanical Equipment GmbH, Oelde (DE)

(72) Inventors: Wilfried Mackel, Lippetal-Herzfeld (DE); Thomas Bathelt, Oelde (DE); Andreas Penkl, Lippetal (DE); Dieter Strauch, Oelde (DE)

(73) Assignee: GEA Mechanical Equipment GmbH, Oelde (DE)

( * ) Notice: Subject to any disclaimer, the term of this patent is extended or adjusted under 35 U.S.C. 154(b) by 945 days.

(21) Appl. No.: 14/388,118

(22) PCT Filed: Mar. 22, 2013

(86) PCT No.: PCT/EP2013/056015
§ 371 (c)(1),
(2) Date: Sep. 25, 2014

(87) PCT Pub. No.: WO2013/143985
PCT Pub. Date: Oct. 3, 2013

(65) Prior Publication Data

US 2015/0051059 A1 Feb. 19, 2015

(30) Foreign Application Priority Data

Mar. 26, 2012 (DE) ..... 10 2012 102 593
Jan. 9, 2013 (DE) ..... 10 2013 100 180

(51) Int. Cl.
*B04B 1/14* (2006.01)
*B04B 15/08* (2006.01)
(Continued)

(52) U.S. Cl.
CPC ..... *B04B 15/08* (2013.01); *B04B 1/14* (2013.01); *B04B 7/02* (2013.01); *B04B 9/02* (2013.01); *B04B 15/02* (2013.01)

(58) Field of Classification Search
CPC ..... B04B 15/08; B04B 15/02; B04B 9/02; B04B 7/02; B04B 1/14
(Continued)

(56) References Cited

U.S. PATENT DOCUMENTS 4,205,779 A * 6/1980 Jacobson ..... B04B 9/04 494/14
4,689,157 A * 8/1987 Tenthoff ..... B04B 1/14 210/371
(Continued)

FOREIGN PATENT DOCUMENTS

DE 199 22 237 A1 12/2000
DE 203 07 913 U1 9/2003
(Continued)

OTHER PUBLICATIONS

International Search Report dated May 8, 2014 with English translation (five (5) pages).
(Continued)

*Primary Examiner* — Charles Cooley
(74) *Attorney, Agent, or Firm* — Crowell & Moring LLP

(57) ABSTRACT

A separator arrangement includes a drum with a vertical axis and which is rotatably mounted in a hooded area and placed on a rotatable drive spindle. The arrangement also includes a sealed drive area containing one or more or all of the components of a separator drive, and a pump that generates negative pressure in the sealed drive area relative to the surroundings outside of the drive area.

1 Claim, 3 Drawing Sheets

(51) Int. Cl.
*B04B 7/02* (2006.01)
*B04B 9/02* (2006.01)
*B04B 15/02* (2006.01)

(58) Field of Classification Search
USPC ..... 494/15, 61, 84
See application file for complete search history.

(56) References Cited

U.S. PATENT DOCUMENTS 4,941,866 A * 7/1990 Gorodissky ..... B04B 15/08 494/14
4,946,433 A * 8/1990 Gorodissky ..... B04B 9/12 184/31
6,390,964 B1 5/2002 Mackel
6,530,871 B1 * 3/2003 Mackel ..... B04B 11/04 494/37
6,988,980 B2 * 1/2006 Moss ..... F16J 15/42 184/6.18
9,844,786 B2 * 12/2017 Mackel ..... B04B 7/02
2009/0233780 A1 * 9/2009 Mackel ..... B04B 9/12 494/15
2012/0040816 A1 * 2/2012 Thorwid ..... B04B 7/02 494/14
2014/0057772 A1 * 2/2014 Mackel ..... B04B 1/14 494/37
2014/0249012 A1 * 9/2014 Mackel ..... B04B 9/04 494/15
2015/0051059 A1 * 2/2015 Mackel ..... B04B 15/02 494/14
2015/0283561 A1 * 10/2015 Mackel ..... B04B 9/04 494/10

FOREIGN PATENT DOCUMENTS

EP 1 119 416 B1 4/2003
JP 3-258359 A 11/1991
JP 2001-321699 * 11/2001
RU 2 041 742 C1 8/1995
WO WO 03/086571 A1 10/2003
WO WO 2010/101524 A2 9/2010

OTHER PUBLICATIONS

German-language Written Opinion (PCT/ISA/237) dated May 8, 2014 (five (5) pages).
Russian Office Action issued in Russian counterpart application No. 2014142175/05(068267) dated Dec. 30, 2016 (Two (2) pages).
European Patent Office Communication Pursuant to Rule 71(3) EPC issued in European counterpart application No. 13 714 233.7-1712 dated Nov. 29, 2017 (Two (2) pages).

* cited by examiner

METHOD FOR OPERATING A SEPARATOR WITH A DRIVE CHAMBER UNDER NEGATIVE PRESSURE

BACKGROUND AND SUMMARY OF THE INVENTION

Exemplary embodiments of the invention relate to a separator arrangement.

For various applications of separators, in particular in the area of medical or food technology or milk processing, centrifuge drums are arranged and operated in a chamber having negative pressure in relation to the surrounding area.

European patent document EP 1 119 416 B1 discloses a generic separator arrangement comprising a separator drum for liquid/liquid/solid separation, which has a vertical rotational axis and which is arranged in a sealed receptacle or hooded chamber in which negative pressure in relation to the surrounding area is able to be generated by way of a pump. The separator drum comprises a feed pipe and one or several impellers for discharging the one or several liquid phases as well as solid matter discharge openings for continuously or intermittently discharging solid matter.

The generic structure and its method of operation have proved their worth.

Nevertheless there is a requirement for further improvement of the known separator arrangement and of the method for the operation thereof.

According to one aspect of the invention at least the drive chamber is put under negative pressure in relation to the surrounding area, in particular, in order to achieve an energy saving on rotating parts of the region.

For this purpose, negative pressure in relation to the surrounding area is generated completely or at all events in a part region in the chamber that includes components of the drive device—in particular components of the motor, coupling, spindle, bearing and/or other drive components.

To this end, the drive chamber region can be evacuated by way of a pump or another device that generates negative pressure and/or it is connected to the (hooded) chamber surrounding the drum such that a pump or a corresponding device, which, where applicable, generates a vacuum additionally in the chamber, is also able to generate a vacuum in the drive chamber "at the same time". When the hooded chamber in which the drum is arranged is also put under negative pressure in relation to the surrounding area, an energy saving can also be achieved here too.

It is particularly advantageous according to one variant, which also forms an independent invention, to have a negative pressure connection on a particularly large radius in the hooded chamber as in this case the drum rotation has a supporting effect on the generation of the vacuum. In this case, both the drum and the hooded chamber are preferably realized in portions in a conical manner.

One variant for a negative pressure connection can be a connection via a bore in the spindle. In this case, the free end of the spindle is guided downward through the sealed frame wall and the attaching to a negative pressure system is effected via sealed connections. The bore in the spindle ends in the region below the drum in the hooded chamber. The feed through of the spindle through the frame wall is also sealed by means of mechanical elements.

Conventional impellers are suitable as liquid drainage outlets in the drum. However, also conceivable is sealing/insulating the centripetal pump/drum by means of a submerging disk.

The non-continuously utilizable laboratory centrifuge of Japanese patent document JP 32 58 359 A can also be named as part of the technological background, where the products to be centrifuged are received in sample vessels such that the product is well protected during centrifuging.

Using a liquid-cooled, in particular oil-cooled or water-cooled, motor is particularly advantageous.

It appears advantageous to arrange the oil-lubricating system, in particular a circular lubricating system, also in the vacuum region, in particular with one or several of the following features:

oil circulating pump in the vacuum region oil container in the vacuum region, heat exchanger (for oil circuit) in the vacuum region.

A coolant supply through the drum (in the manner of German patent document DE 19922237) also appears advantageous.

It is additionally particularly advantageous when in operation negative pressure below atmospheric pressure, in particular 0.3 bar less than this, preferably 0.4 bar less than this, in particular 0.7 bar less than this, is generated.

It is additionally advantageous when the value of the negative pressure is modified at all events in the hooded chamber with the drum during operation in dependence on the operating state. This, once again, is an advantageous invention. Thus, for example, in time prior to, during or after a modification in the operating state, the negative pressure can also be modified. In this case, the modification in the operating state, which is modified prior to, during or after the modification in the negative pressure, can be a solid matter ejection. For example, the negative pressure can be somewhat increased briefly prior to or at least during the ejection (e.g. from 0.2 bar to 0.5 bar) and lowered again after the ejection (e.g. back to 0.2 bar) so that no disadvantageous effects occur during a solid matter ejection on account of the high negative pressure.

According to a further advantageous variant, the modification in the operating state, for example, prior to, during or after the modification in the negative pressure, can be an incoming or outgoing/discharge phase.

The invention is particularly suitable for a separator arrangement with a separator having a drum with a vertical rotational axis, which is placed onto a rotatable drive spindle and is surrounded by a hood, the drum comprising a drum diameter greater than 500 mm, in particular 800 mm, in a quite especially preferred manner greater than 900 mm and/or speeds for example greater than 8000 rpm, 5000 rpm, 4000 rpm in operation.

The circumferential speed at the drum outside diameter is preferably at least 100 m/s or more.

The surface of the drum is additionally preferably between 0.5 $m^2$ and 5 $m^2$, in particular 1-3.5 $m^2$ such that the action of supporting the negative pressure generation has a particularly advantageous effect.

BRIEF DESCRIPTION OF THE DRAWING FIGURES

The invention is described in more detail by way of an exemplary embodiment with reference to the drawing, in which.

DETAILED DESCRIPTION

Figure 1:
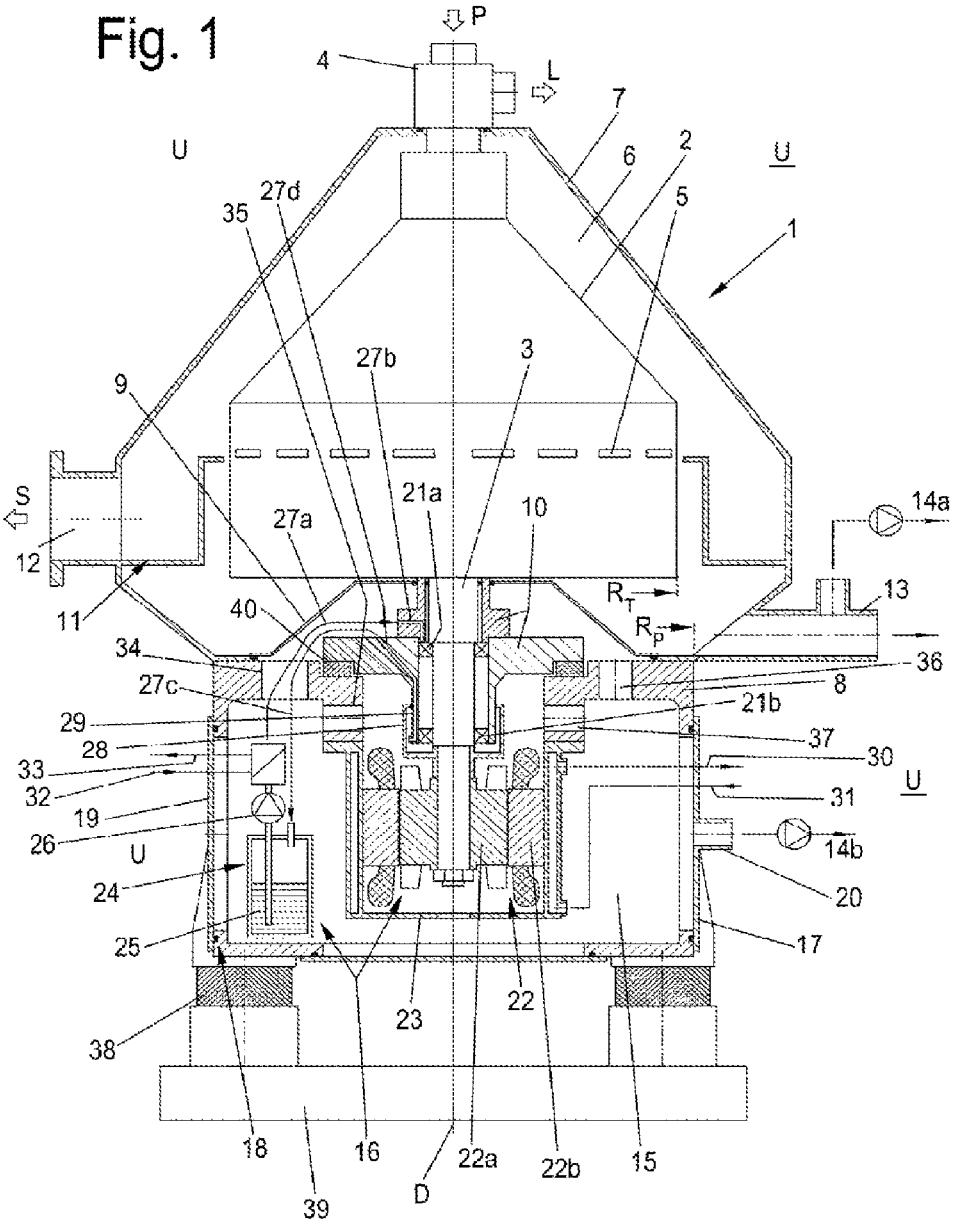
FIG. 1 shows a schematic representation of a first separator arrangement according to the invention with a drive chamber shown in section.

FIG. 1 shows a separator arrangement 1 with a separator with a vertical rotational axis D, the separator comprises a rotatable drum 2, which is placed onto a rotatable spindle 3. The product feed line of a product P that can be processed in continuous operation is effected preferably from the top through a feed pipe 4 (not shown in detail here). The design is preferred. However, a suspended drum with a drive above the drum is also realizable.

During processing in continuous operation, the product to be processed is directed or supplied continuously into the drum, continuously centrifuged and at least one or all of the phases formed during purification and/or separation is/are also continuously drained off. Liquid phase(s) is/are continuously drained off. A solid matter phase, which is also formed where applicable, can be discharged continuously through nozzles or not continuously for example by way of openings which can be closed by way of piston valves.

The drum 2 is designed in this case for the purpose of separating the product P to be processed into at least one liquid phase L or several liquid phases as well as a solid matter phase S. In this case, it preferably comprises, similar to the drum disclosed in European patent document EP 1 119 416 B1 or the equivalent used in practice, a stack of separating disks produced from separating disks (not visible here) in the interior.

The liquid phases L are drained out of the drum 2 via liquid outlets, in particular impellers in the manner of a centripetal pump. The draining off of the solid matter phase S is effected, in contrast, either discontinuously at discontinuously closable solid matter discharge openings 5 in the drum outer surface or continuously through nozzles in the drum outer surface.

The use in particular of a liquid-controlled piston valve appears advantageous.

The drum 2 is inserted into a hooded chamber 6, which is sealed in relation to the surrounding area.

The hooded chamber 6 is defined in this case by a hood 7, which is fixed to a base—in this case a machine frame 8, a cover 9 below the drum that is fixed to the hood 7 as well as a spindle housing 10 which is passed through by the drive spindle 3.

In this case, suitable seals are arranged preferably between adjoining elements such as between the hood 7 and the machine frame 8 as well as between the cover 9 and the hood 7 as well as between the cover 9 and the spindle housing 10 and between the spindle housing 10 (fixed) and the drive spindle 3 (which rotates in operation) in order to realize a sealed design.

A solid matter collector 11, which serves to drain solid matter emerging from the drum out of the hooded chamber through a solid matter drainage line 12, is formed in the hood 7.

A pump 14*a* (or another device for lowering the pressure in the hooded chamber 6 in relation to the surrounding area), by way of which negative pressure in relation to the surrounding area U outside the hooded chamber 6 can be generated in the hooded chamber 6, is additionally connected to the hooded chamber 6 at a negative pressure connection 13.

The negative pressure connection 13 is preferably realized at a position which, in relation to the rotational axis D, lies on a relatively large radius $R_P$, in particular on a radius which is identical to or greater than the largest radius $R_T$ of the drum 2.

As a result of operation at negative pressure, in particular at a negative pressure which is more than 0.2 bar lower than the atmospheric pressure in the surrounding area U, the energy consumption to drive the drum 2 can be reduced. This is admittedly already known per se, thus is from the prior art already mentioned in the introduction.

Compared to the prior art, the energy consumption of the separator arrangement 1, in this case, is then further reduced again as a result of not only the hooded chamber 6 in which the drum 2 is arranged but also a drive chamber 15 in which one or several components of a separator drive 16 are arranged, being designed in such a sealed manner that once again, by way of at least one further pump 14*b* or also by way of the pump 14*a*, negative pressure, in particular negative pressure of more than 0.2 bar, in relation to the atmospheric pressure in the surrounding area U is able to be generated or is generated therein in operation.

The drive chamber 15 is defined in this case by a drive enclosure 17, which is realized corresponding to the object to generate negative pressure in relation to the surrounding area U in the drive chamber 15, once again in a correspondingly sealed design. To this end, suitable seals 18 are realized once again between elements of the drive enclosure 17 according to FIG. 1.

In this case, the drive chamber 15 is surrounded by the machine frame 8 as well as closure panels 19 that close openings of the machine frame. It is defined toward the top by the cover 9 below the drum 2 and the one-part or multiple-part spindle housing 10.

The pump 14*b* is connectable to a negative pressure connection 20 of the drive chamber 15.

One or several or even all of the elements of the separator drive 16 are housed in the drive chamber 15. Only the drive spindle 3 projects, according to FIG. 1, out of the drive chamber into the hooded chamber by way of its upper end.

The spindle bearing arrangement is preferably arranged completely or in part—in this case both a neck bearing 21*a* and a foot bearing 21*b*—in the negative pressure region. However, it is also conceivable for one (in particular the neck bearing 21*a*) or both bearings 21*a, b* not to be associated with the negative pressure region.

The spindle housing 10 rests in a flange region on the machine frame 8 supported on elastic elements 40.

Arranged in an equally preferred manner in the negative pressure region is the drive motor 22 which, in this case, is realized directly in axial elongation of the drive spindle 3 such that a so-called direct drive is formed for the drum 2.

The rotor 22*a*, in this case, is fastened directly on the drive spindle 3 and the stator 22*b* is fastened in a motor housing 23 which, in turn, is fastened on the side of the machine frame 8 that is remote from the hooded chamber 6. Precisely such a direct drive can be accommodated in a preferred manner in the drive chamber, it also being possible, however, for the electric drive motor 22 to be arranged between the bearings 21*a, b* (latter variant is not shown here). In addition, it is also conceivable to accommodate the drive motor in the negative pressure region of the drive chamber 15 which is connected to the drive spindle 3 by means of a coupling (not shown here either).

A lubrication system 24, which serves for lubricating the spindle bearing arrangement 21 and/or for lubricating components on the motor, is also arranged in the drive chamber 15.

The lubricating system, in this case, comprises a lubricant circuit comprising the elements oil container 25, pump 26, feed line 27*a, b* to the spindle bearing arrangement 21, oil collecting container 28 that is connected non-rotatably to the spindle and in which in operation an oil level is formed on a radius on account of the cup-like development, an impeller member 29 that drains off the oil in the collecting container, as well as a return line 27*c, d* into the oil container 25. In this case, all the elements of the lubricating system are accommodated in an advantageous and compact manner in the negative pressure region, i.e. in the drive chamber.

In addition, drainage and feed lines 30, 31, 32, 33 open out into the drive chamber from one or several coolant circuits, in this case one for the motor 22 and one for the lubricating system 24.

In addition, one or several passage openings 34, 35, 36, 37, which ensure that no pressure gradients occur where possible inside the drive chamber 15, are realized in the machine frame.

As negative pressure is also generated in the drive chamber 15 relative to the surrounding area, a further energy saving can also be achieved in operation on the rotating parts in the drive chamber.

It must also be mentioned that the entire separator or the machine frame is supported on a base 39 by elastic foot elements 38.

Figure 2:
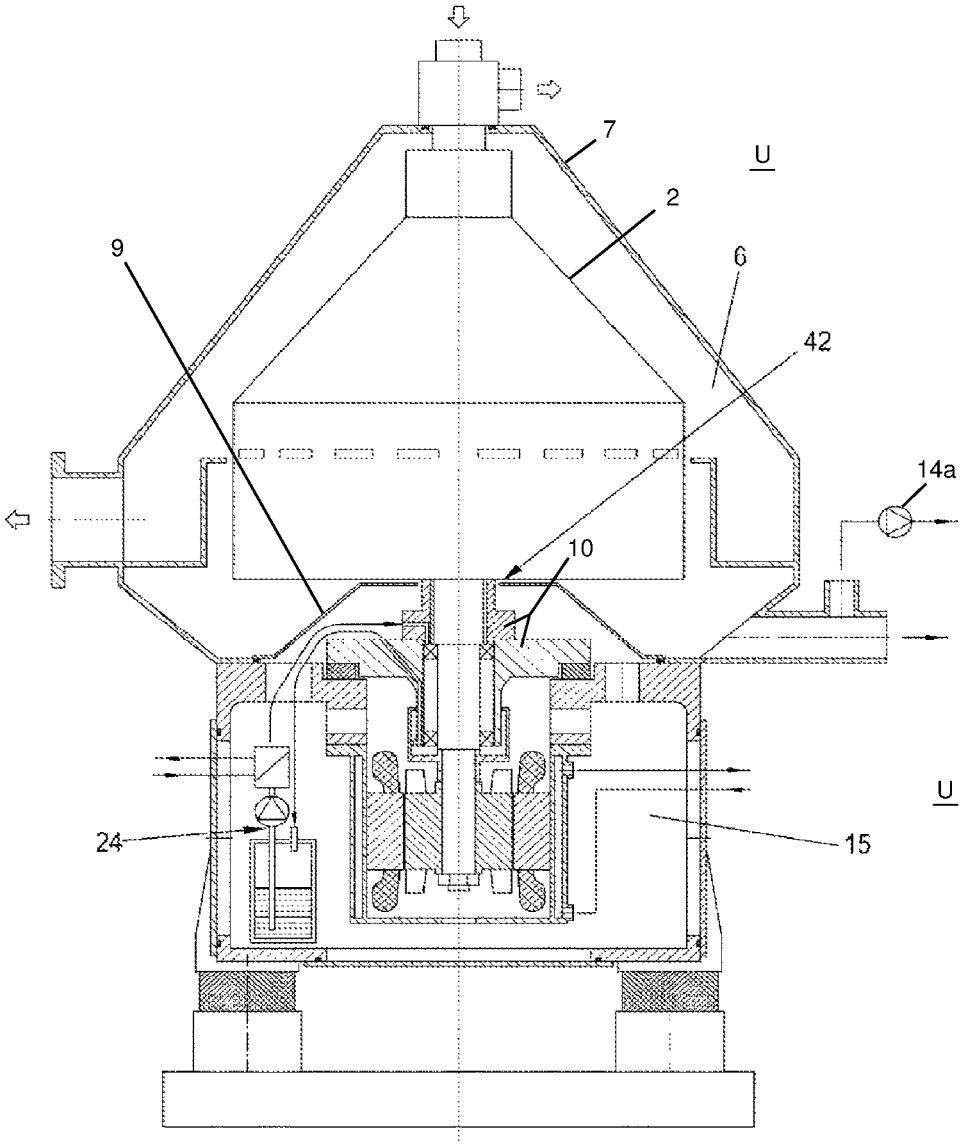
FIG. 2 shows a schematic representation of a second separator arrangement according to the invention with a drive chamber shown in section.

According to FIG. 2, the hooded chamber 6 and the drive chamber 15 are not sealed against one another. In this case, this is achieved in an exemplary and simple manner by the cover 9 below the drum 2 not being sealed radially inward to the spindle housing 10 but by a gap 42, which ensures pressure equalization between the hooded chamber 6 and the drive chamber 15, being realized between the elements. In this connection, no seal, for example no mechanical seal is required.

In such a manner, the negative pressure can be generated at the same time in the two chambers 6, 15, where applicable even by way of just one single pump 14*a*. However, several pumps can also be provided.

Overall, also according to FIG. 2, both the region inside the hood 7 together with the drive chamber 15, including one or several, in particular also rotatable, drive components, is also sealed in relation to the surrounding area U of the hood 7 such that it is possible to put the region under negative pressure in relation to the surrounding area U by way of a pump 14*a, b*, which is able to pump air/gas out of the region between the hood 7 and the drum 2 and/or the drive chamber 15.

The entire energy of the motor and the oil supply of the drive (motor) is also effected according to FIG. 2 in the closed drive chamber 15.

Figure 3:
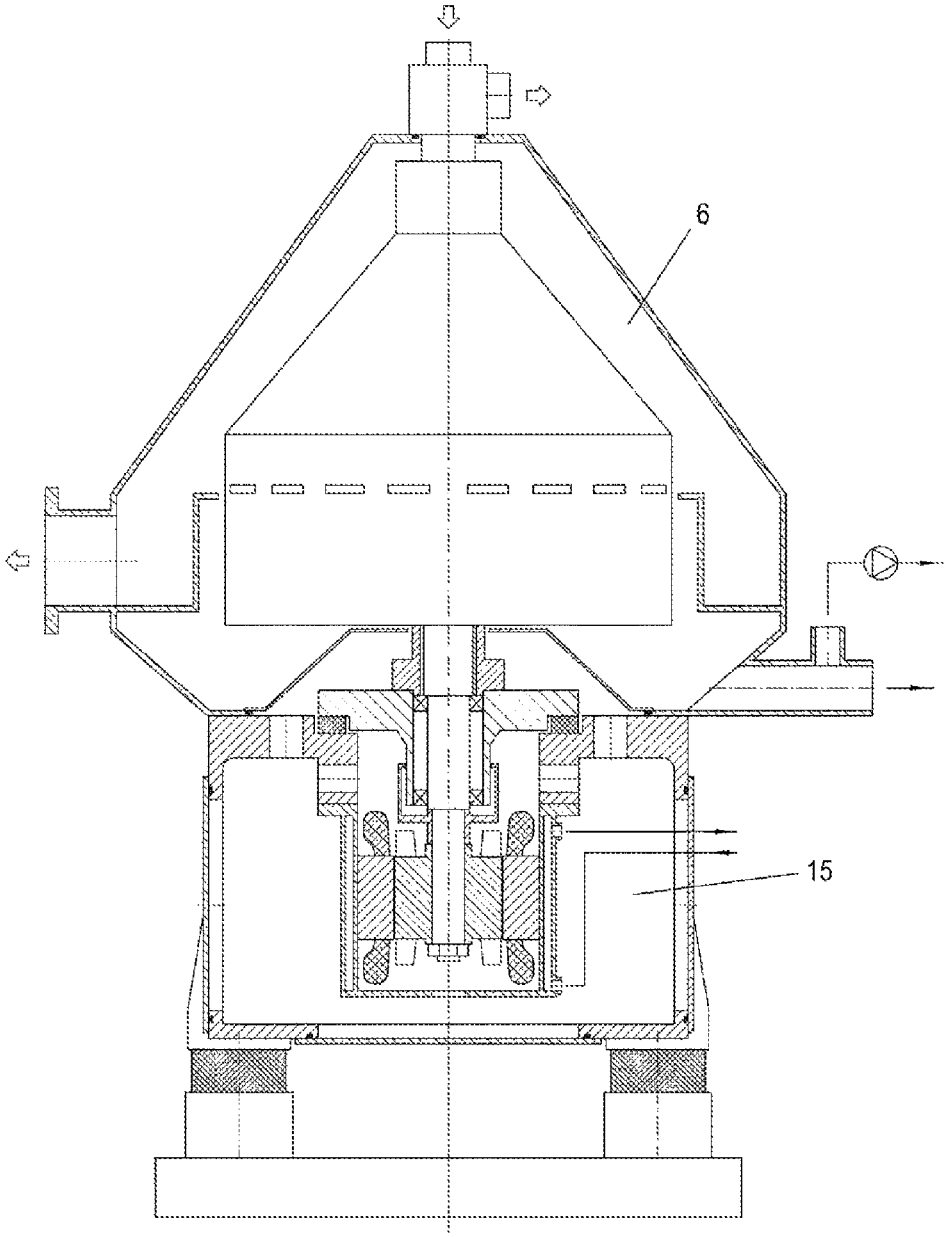
FIG. 3 shows a schematic representation of a third separator arrangement according to the invention with a drive chamber shown in section.

According to FIG. 3, in contrast, no circulating lubrication or no lubricating circuit is arranged inside the drive chamber 15. The lubricating oil supply and drainage is effected in this case by means of an externally (outside the drive chamber) installed lubricating oil unit (not shown here).

All the separator arrangements of FIGS. 1 to 3 meet even the highest energy saving requirements.

It must be stressed once again as particularly advantageous that in FIGS. 1-3 in each case the pump 14*a* for generating the negative pressure as a result of suction is arranged on a large, in particular on the largest radius/diameter of the hood 7.

In particular, the suction is effected on a radius of the hood 7 which, with reference to the rotational axis, lies on a radius which is greater than 80%, in particular more than 100%, of the largest drum radius. In particular, the support produced by the differential pressure action of the drum has an advantageous effect in this case.

Conceivable also/as an alternative to this is a negative pressure connection on a solid matter container (not shown here).

One or a further negative pressure connection in the control water discharge region below the drum (not shown here) is also advantageous.

One or a further negative pressure connection through the spindle 3 into the drive chamber 15 (e.g. a bore in the case of machines with an external oil unit) would also be advantageous and structurally simple.

Also advantageous is a sealed/insulated development of the impellers by means of a centripetal pump. Also advantageous is the use of a hermetic centripetal pump/pump combination (not shown).

Particularly advantageous is the use of a liquid-cooled, in particular oil-cooled or water-cooled, motor as the cooling effect by air is reduced as a result of the negative pressure in the drive chamber.

The separator arrangement according to the manner of FIG. 1 meets even the highest energy saving requirements.

It is also advantageous that in FIG. 1 the pump (14*a*) for generating the negative pressure as a result of suction is placed on a large, in particular largest diameter of the hood. In particular, the suction is effected at a diameter of the hood which, with reference to the rotational axis, lies on a larger radius than the largest drum radius. In particular, the support produced by the differential pressure action of the drum has an advantageous effect in this case.

Equally advantageous is one or a further negative pressure connection to the pump 14*b* in the drive chamber or on a solid matter container (not shown here) in the center with a large diameter "elongation pipe" for "keeping clean" the negative pressure connection.

Equally advantageous is one or a further negative pressure connection to the pump 14*b* in the drive chamber or on a connection in the control water discharge region below the drum (not shown either).

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

LIST OF REFERENCES

Separator arrangement 1
Rotational axis D
Drum 2
Drive spindle 3
Product P
Feed pipe 4
Liquid phases L, L1, L2
Solid matter discharge openings 5
Hooded chamber 6
Hood 7
Machine frame 8
Cover 9
Spindle housing 10

Solid matter collector 11
Discharge line 12
Connection 13
Pump 14*a, b*
Surrounding area U
Radius Rp, RT
Drive chamber 15
Separator drive 16
Drive enclosure 17
Seals 18
Closure panels 19
Connection 20
Neck bearing 21*a*
Foot bearing 21*b*
Drive motor 22
Rotor 22*a*
Stator 22*b*
Lubricating system 24
Oil container 25
Pump 26
Feed line 27
Oil collecting container 28
Impeller member 29
Drainage and feed lines 30, 31, 32, 33
Passage openings 34, 35, 36, 37
Foot elements 38
Base 39
Elastic elements 40
Gap 42

The invention claimed is:

1. A method for operating a separator, the method comprising:

rotating a rotatable drum arranged in a hooded chamber, wherein the rotatable drum has a vertical rotational axis and is arranged on a rotatable drive spindle;

generating, by a pump, in a sealed drive chamber including one, several or all components of a separator drive, negative pressure in the sealed drive chamber in relation to a surrounding area outside the sealed drive chamber; and generating negative pressure in the hooded chamber, wherein the negative pressure in the hooded chamber is modified in dependence on an operating state of the separator and wherein the operating state is a solid matter ejection from the rotatable drum;

wherein the negative pressure in the hooded chamber is increased prior to or during the solid matter ejection from the rotatable drum and is lowered from the increase after the solid matter ejection.

* * * * *